United States Patent [19]

Jabsen

[11] 4,359,088

[45] Nov. 16, 1982

[54] STEAM GENERATOR TUBE SUPPORTS

[75] Inventor: Felix S. Jabsen, Lynchburg, Va.

[73] Assignee: The Babcock & Wilcox Company, New Orleans, La.

[21] Appl. No.: 209,085

[22] Filed: Nov. 21, 1980

[51] Int. Cl.[3] ..... F28F 9/00

[52] U.S. Cl. ..... 165/172; 122/510; 165/162

[58] Field of Search ..... 165/162, 172; 122/510

[56] References Cited

U.S. PATENT DOCUMENTS

| | | | |
|---|---|---|---|
| 3,176,762 | 4/1965 | Greenwood et al. | 165/162 |
| 3,399,719 | 9/1968 | Forrest et al. | 165/162 |
| 3,420,297 | 1/1969 | Romanos | 165/162 |
| 3,600,792 | 8/1971 | Valluy | 165/172 X |
| 4,013,121 | 3/1977 | Berger et al. | 165/162 |
| 4,021,204 | 5/1977 | Straffi | 165/162 X |
| 4,036,461 | 7/1977 | Soligno | 165/162 |
| 4,160,477 | 7/1979 | Roffler | 165/162 X |

FOREIGN PATENT DOCUMENTS

| | | | |
|---|---|---|---|
| 2263056 | 7/1974 | Fed. Rep. of Germany | 165/172 |
| 2751744 | 5/1979 | Fed. Rep. of Germany | 165/162 |
| 367842 | 4/1963 | Switzerland | 165/162 |

*Primary Examiner*—Sheldon J. Richter

*Attorney, Agent, or Firm*—Robert J. Edwards; R. C. Mai

[57] ABSTRACT

A steam generator tube support structure having three sets of mutually parallel strips each set extending in a different direction oriented sixty degrees from the other two. One set of strips is slotted at both edges. The other two sets of strips are slotted on one edge. The strips engage to form hexagonal cells for supporting and aligning a triangular array of tubes. Dimples in the strips provide point tube support.

7 Claims, 13 Drawing Figures

STEAM GENERATOR TUBE SUPPORTS

BACKGROUND

The present invention relates to heat exchangers, and more particularly to a tube support structure for a tube and shell stream generator.

Tube and shell stream generators such as those used in nuclear power plants include a vessel containing a large number of stainless steel tubes affixed at their ends to tube sheets. The tubes are typically arranged in an equilateral triangular array and are supported at a number of positions along their length by support structures. Support structures for steam generators should hold the tubes rigidly to thereby supress vibration, should impose a minimum of resistance to the flow of fluid around the tubes, and should minimize the occurrence of crevices around the tubes where impurities may build up. Tube support structures of the prior art have to a large extent failed in one or more of these objectives. The orifice type support plate presented a high resistance to fluid flow. This type also suffered from a large number of crevices around the tubes. As impurities deposited and built up between a tube and the plate, the tube was pinched together. This phenomenon is commonly known as "denting".

The broached plate type tube support also suffers from the denting phenomenon albite to a far less degree than the orifice type plate.

Moreover, plate type supports are extremely expensive to fabricate and transport.

Other types of support structures include bars held between rows of the tubes. However, these structures are prone to flow induced vibrations resulting in damage to the tubes.

SUMMARY OF THE INVENTION

The present invention overcomes the disadvantages of the prior art to a large extent. A unique "egg crate" structure is employed to yield low flow resistance, high strength and low cost.

In an equilateral triangular array of tubes, such as in a steam generator, each tube is equidistant from six surrounding tubes and is a member of three identifiable rows of tubes, each of the three rows being oriented in a corresponding direction rotated sixty degrees relative to the directions of the other two rows. The present invention includes three groups of grid strips each running through the tubes along a corresponding one of the three directions.

In one embodiment, one group of strips are full height and run between the tubes in the first direction, the second and third groups of strips are of a partial height and run between the tubes in the second and third directions respectively. The full height strips are slotted on both the top and bottom edges for receiving the partial height strips being slotted on only one edge.

The strips are dimpled to provide a contact to the steam generator tubes. The structure of the present invention provides a number of advantages including simplicity and decreased time of fabrication; a decrease in pressure drop of fluids going through the structure thereby enabling a reduction in required pumping power; reduction of shipping weight; decrease of vibration of tubes and steam generator oscillation; increased flexibility of the grid resulting in increased flexibility of the tubes to reduce the occurrence of denting; better steam flow conditions and better flow distribution at the upper section of the steam generator due to the open lattice configuration; and the tube supports will not grip the tubes too tightly but will allow slipping to accommodate thermal expansion.

An object of the present invention is a steam generator tube support structure that provides flexible contact support to supress vibration.

A further object of the invention is a structure yielding the foregoing advantages and which is not susceptible to denting.

Another object of the invention is a structure yielding the foregoing advantages and which is simple and inexpensive to construct and transport.

Yet another object of the invention is a structure yielding the foregoing advantages and which poses minimal resistance to fluid flow. These and other objects and advantages of the present invention will become readily apparent through the following description and drawings of preferred embodiments of the present invention.

BRIEF DESCRIPTION OF THE DRAWINGS

FIG. 19 is a partial elevational view taken along line X—X of FIG. 9;

DETAILED DESCRIPTION OF THE PREFERRED EMBODIMENTS

Figure 1:
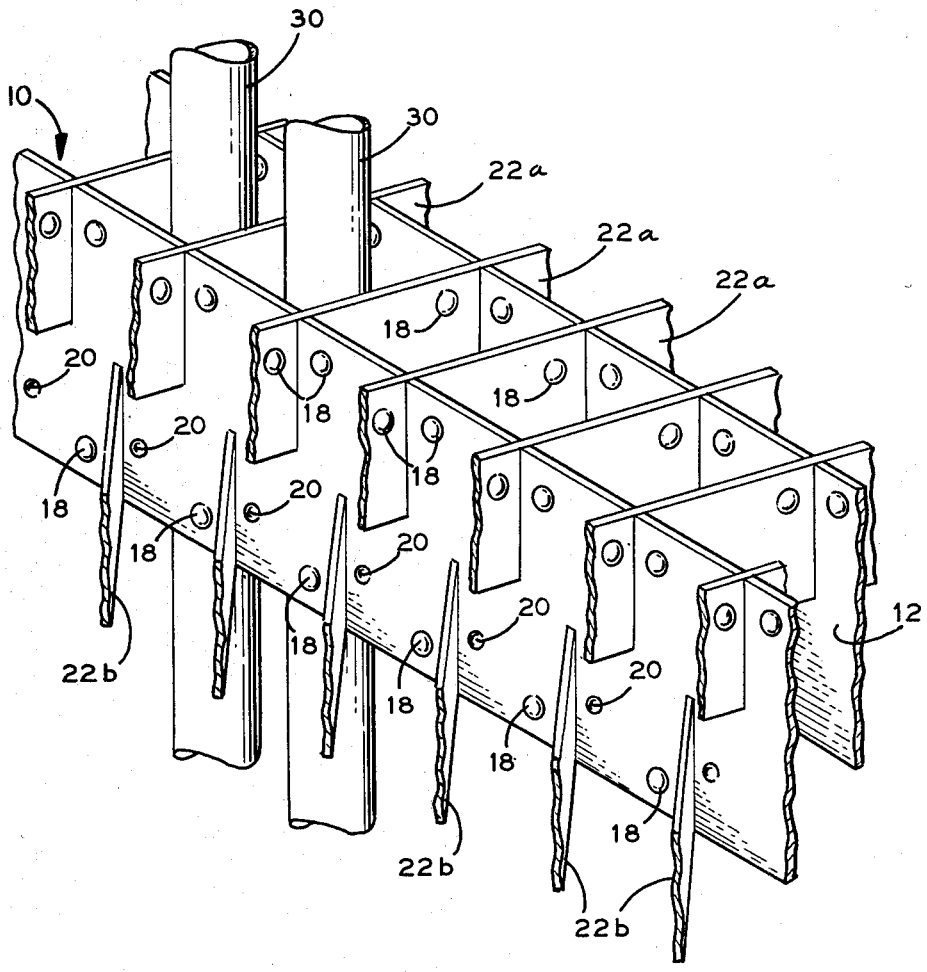
FIG. 1 is a partial perspective view of the preferred embodiment of a steam generator tube support structure according to the present invention.

Refer now to FIG. 1, there being shown a perspective view of a preferred embodiment of the steam generator tube support structure generally referred to by the reference numeral 10 according to the present invention. Structure 10 includes two types of strips 12 and 22 arranged into three strip groups 12, *22a*, and *22b*. The details of the strip types 12 and 22 are discussed in detail below. Note that each of the strip groups are oriented at sixty degree angles with each of the other two groups. When viewed from the top, as in FIG. 7, this orientation of the groups define hexagonal tube cells in an equilateral triangular array.

In FIG. 1, strips 12 are full height and slotted on both the top and bottom edges. Strips *22a* and *22b* are slotted on only the bottom and top edges respectively and are identical in structure.

Figure 2:
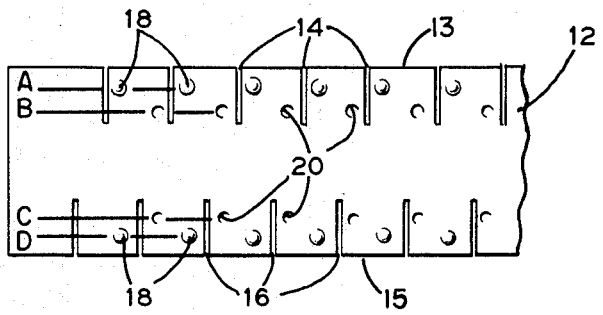
FIG. 2 is a partial elevational view of a full height component strip of the structure of FIG. 1.
Figure 3:
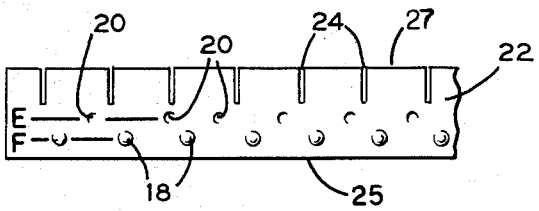
FIG. 3 is a partial elevational view like FIG. 2 showing a partial height strip.

Turn now to FIG. 2 wherein a strip 12 is shown in elevation. Slots 14 and slots 16 are cut in opposing edges 13 and 15 of strip 12 and staggered alignment. The staggered alignment is important to obtain a hexagonal cell. If the alignment was not staggered, but rather, in line, the result would be triangular cells. Dimples 18 are formed in strip 12. Recesses 20 are the back sides of dimples 18. FIG. 3 shows an elevational view of partial height strip 22. Slots 24 are formed in the edge 27 of strip 22. Dimples 18 are also formed in strip 22. When strips 22 are mated with strips 12 via slots 24 and 14, edges 25 and 13 lie generally on the same plane. When strips 22 are mated with strips 12 via slots 24 and 16, edges 25 and 15 lie generally on the same plane.

Figure 4:
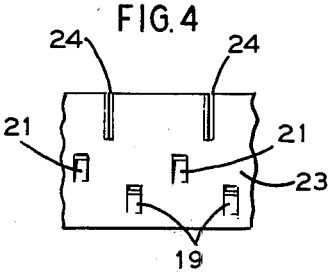
FIG. 4 is a partial elevational view like FIG. 3 showing an alternative dimple structure.

Turn now to FIG. 4 wherein an alternate embodiment of the partial height strip is shown. Strip 23 differs from strip 22 of FIG. 3 in that rectangular dimples 19 are employed. Recesses 21 of dimples 19 are also shown.

Figure 5:
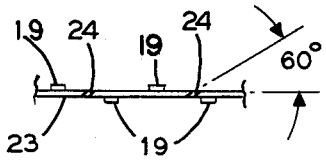
FIG. 5 is a partial plan view of the structure of FIG. 1.

Refer now to FIG. 5 wherein the angle of slots 24 with the plane of strip 23 is shown as sixty degrees. Slots 16 and 14 of strip 12 and slots 24 of strip 22 are also angled at sixty degrees. Note from FIG. 5 that in the preferred embodiment of the invention dimples 19 as well as 18 (not shown) always protrude away from the sixty degree angle formed by the slots 24 as well as 14, 16 and 24 (not shown) with respect to the plane of the strip. In other words, recesses 21 or 20 are always facing into the sixty degree angle. Applying this to strip 12 of FIG. 2 illustrates that slots 14 and 16 are not cut parallel in this direction but rather at angles of sixty degrees with each other (as well as with the strip). This arrangement is necessary of course to assemble the strips to form hexagonal cells.

One further feature of the preferred embodiment that is illustrated by FIGS. 2 through 5 is the judicious positioning of dimples 18 and 19. Assuming that edges 13 and 15 of strip 12 in FIG. 2 lie on a horizontal plane, dimples 18 are positioned to define four additional horizontal planes A, B, C, and D. Similarly, dimples 18 of strip 22 of FIG. 3 define planes E and F.

Figure 6:
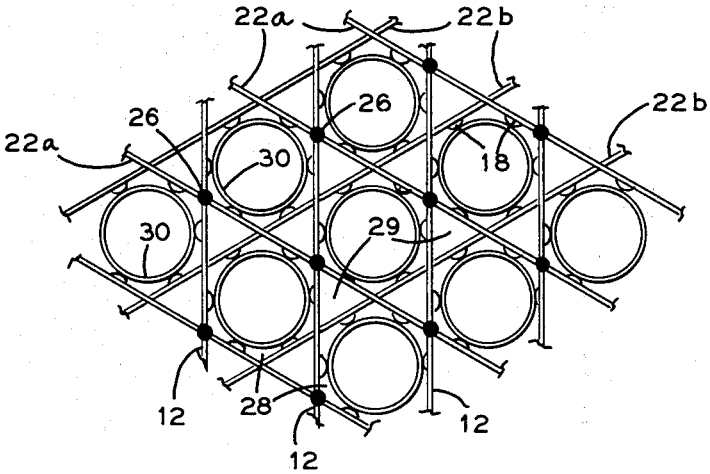
FIG. 6 is a plan view of the steam generator tube support structure according to the present invention.

Upon assembly of strips 22 into strips 12, to form the arrangement of FIG. 2 and also FIG. 6, planes E and F of strips 22*a* lie coplanar with planes B and A respectively of strips 12 and planes E and F of strips 22*b* lie coplanor with plane C and D respectively of strips 12. Thus, upon assembly of the support structure, each hexagonal cell 28 has eight dimples 18 protruding therein.

If desired the strips can be assembled such that directly opposing dimples 18 in each cell 28 always lie in the same plane.

In reference to FIG. 6, note welds 26 which affix strips 22*a* to strips 12 at edge 13. Similar welds (not shown) are provided to affix strips 22*b* to strips 12 at edge 15. Also note in FIG. 6 triangular cells 29 which lie between the hexagonal cells 28. Cells 29 are open to allow the free flow of a fluid therethrough.

Figure 11:
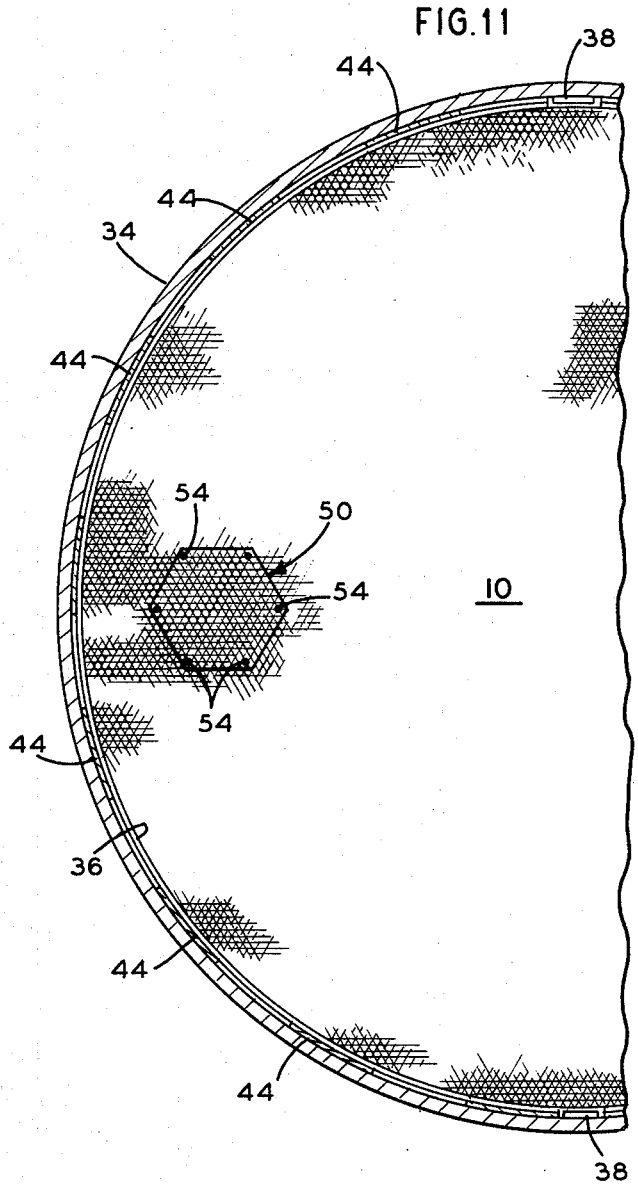
FIG. 11 is a partial plan cross-sectional view of a heat exchanger employing a preferred embodiment of the invention.

Refer now to FIG. 11 which shows a partial sectional plan view of a tube and shell heat exchanger having a shroud 34. Hexagonal support structure 10 as above described is circumscribed by ring 36 which is described in more detail below. Ring 36 is aligned and supported in shroud 34 by keyway logs 38 and wedges 44.

Figure 7:
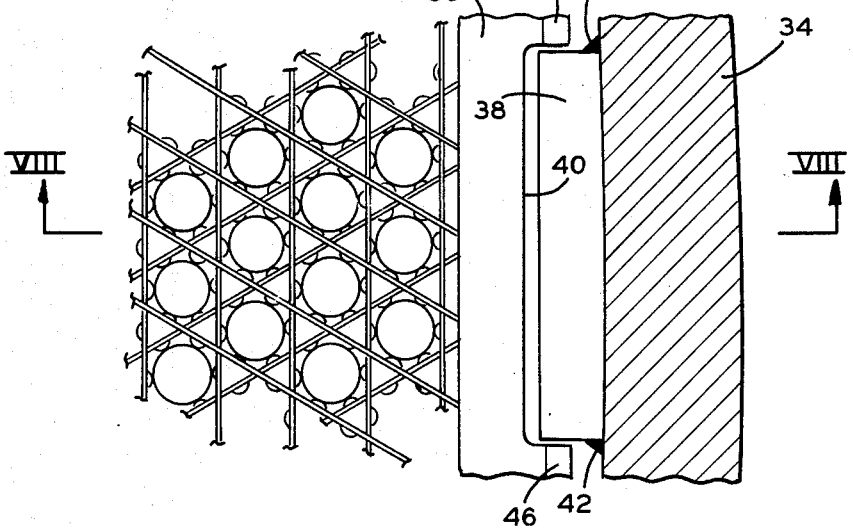
FIG. 7 is a partial plan view of the structure of FIG. 6 showing angular alignment means.

Refer now to FIG. 7 wherein ring 36 is shown in relation to shroud 34. Keyway notch 40 mates with keyway lug 38 to secure and align ring 36 in angular relation with shroud 34. Lug 38 is welded at welds 42 or affixed in some other suitable manner to shroud 34.

Figure 8:
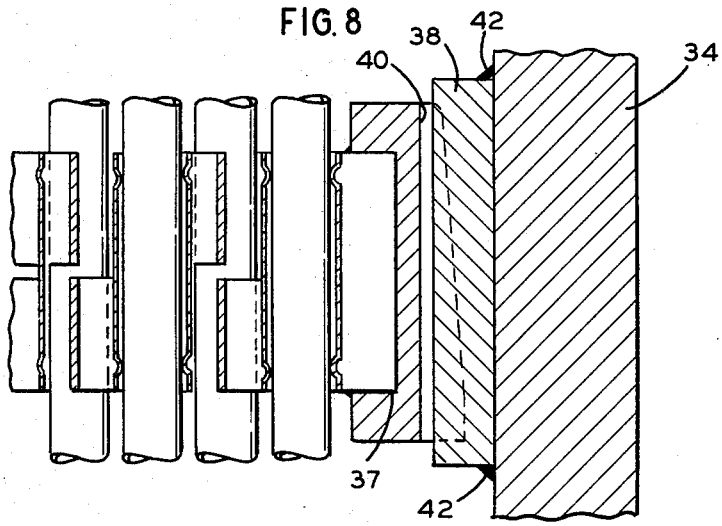
FIG. 8 is a partial elevational view taken along the line VIII—VIII of FIG. 7.

Angle surface 46 of ring 36 is provided in conjunction with wedges 44 described in detail below. Turn now to FIG. 8 wherein a cross-sectional view of FIG. 7 is shown. Note ring notch 37 of ring 36 into which support structure 10 is fit and affixed by welding or other suitable means.

Figure 9:
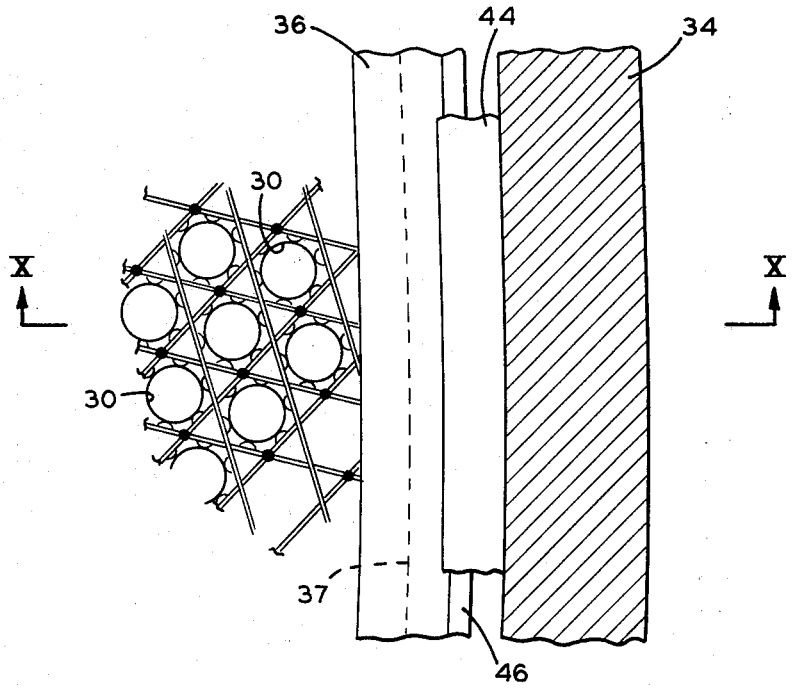
FIG. 9 is a partial plan view of the structure of FIG. 6 showing elevational alignment means.
Figure 10:
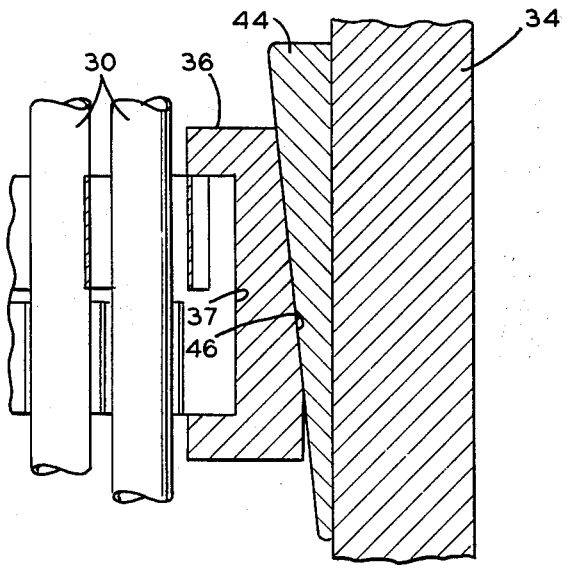

Refer now to FIG. 9 wherein a plan view of a portion of wedge 44 is shown. Wedge 44 is affixed to shroud 34 by welding or other suitable means. Also in this view, ring notch 37 is shown in phantom. FIG. 10 shows the relationship of wedge 34 with ring 36. Surface 46 of ring 36 mates essentially flush with wedge 44 and is affixed thereto by welding or other suitable means. FIG. 10 is an elevational view and wedge 44 tapers downward thereby providing structural interference resistance to the movement of ring 36 in the upward direction. This is so arranged because the net force on ring 36 is in the upward direction due to upward fluid flow in the shell side of the heat exchanger.

Figure 13:
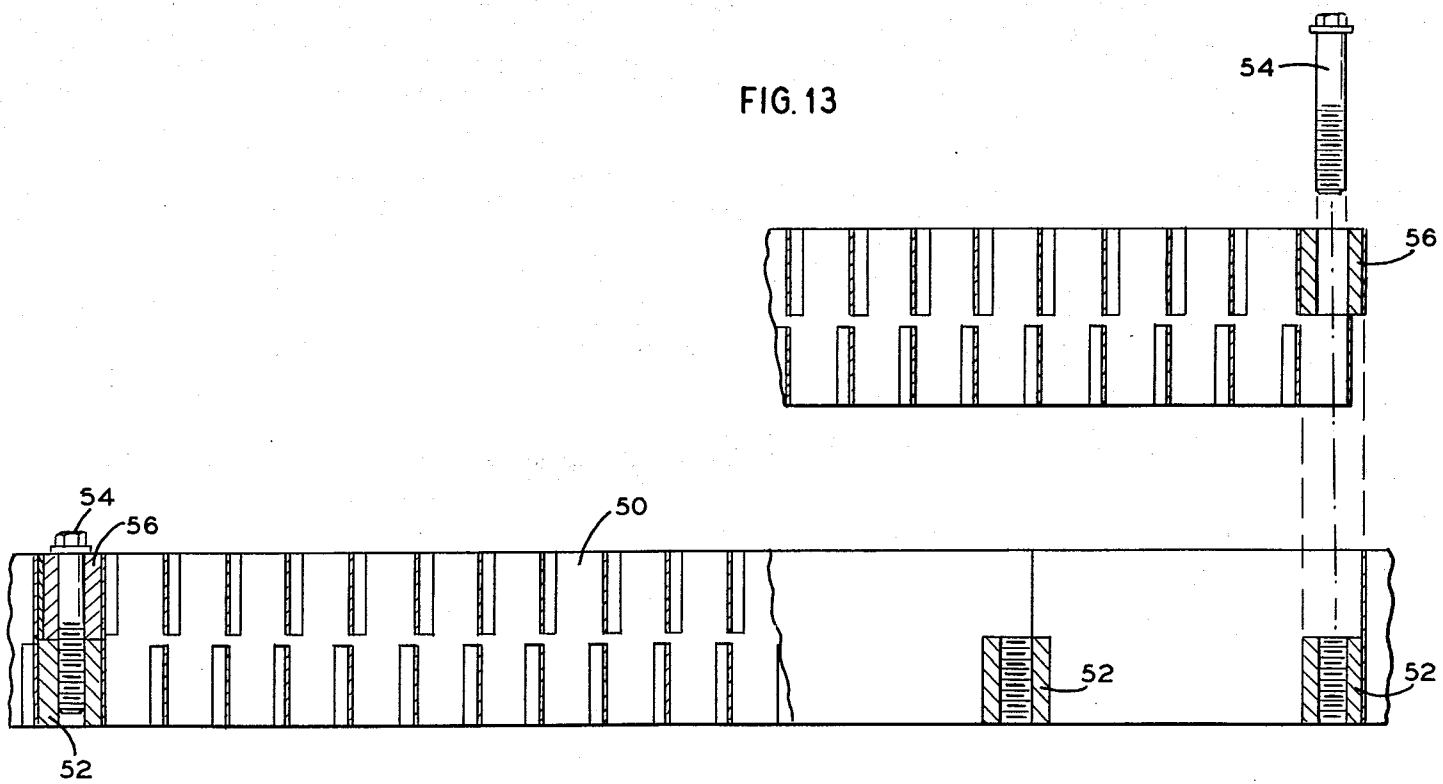
FIG. 13 is a partially exploded sectional elevation view of the manway structure.

Referring back to FIG. 11, attention is drawn to manway 50 which is provided to allow access throughout the heat exchanger during assembly thereof. Bolts 54 are provided to secure manway 50 to grid structure 10. Refer now to FIG. 13 wherein manyway 30 is shown in more detail. Nuts 52 are affixed in structure 10. Bushings 56 are affixed in manway 50 and in axial alignment with corresponding nuts 52. Bolts 54 extend through bushings 56 and threadingly engage nuts 52 thereby affixing manway 50 to structure 10.

Figure 12:
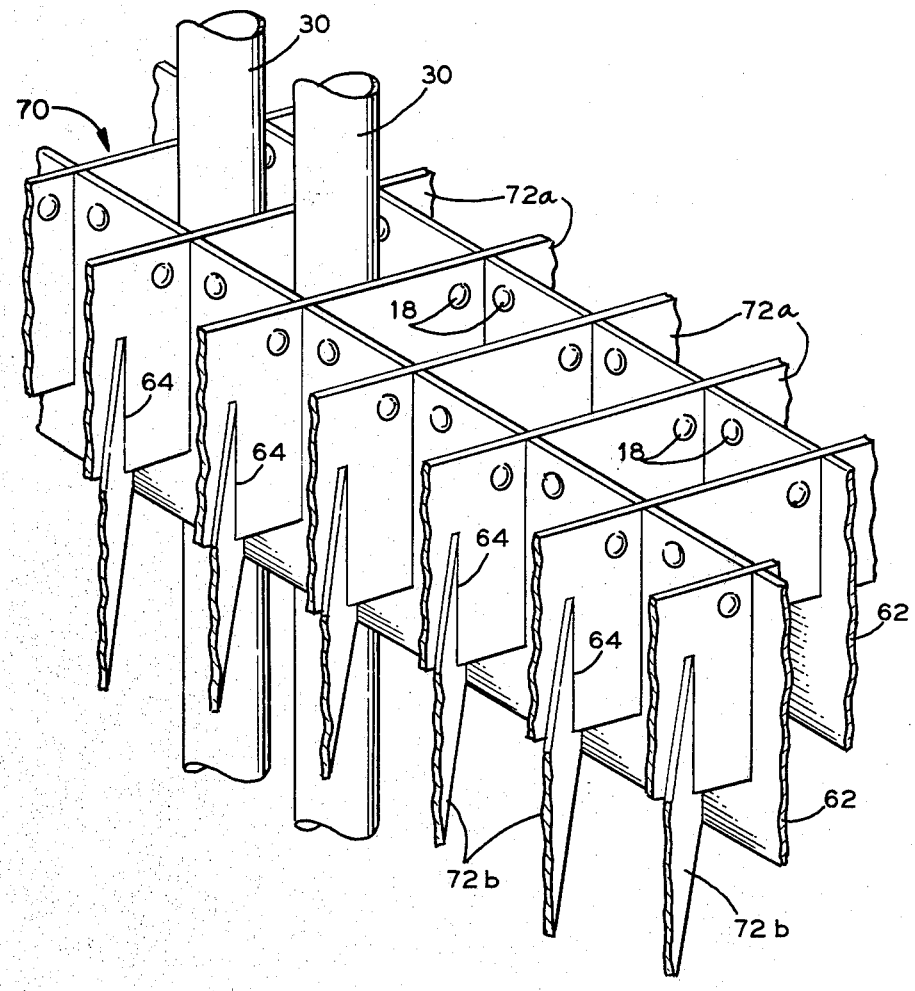
FIG. 12 is a partial perspective view like FIG. 1 showing an alternative embodiment.

Refer now to FIG. 12 wherein an alternate embodiment of the invention, structure 70, is shown. Full height strips 62 lie in a first orientation, partial height strips 72*a* and 72*b* lie in second and third orientations, each orientation being sixty degrees from the other two. This arrangement is the same as above described. The difference in this embodiment is in that strips 72*a* and 72*b* intersect each other at slots 64. This was not the case for strips 22*a* and 22*b* in structure 10.

The overlapping provides additional regidity and strength for structure 70 in the lateral direction. The overlapping could extend all the way to the edges of strip 72*a* and 72*b*. In such a configuration strips 72*a* and 72*b* would be of the same height as strips 62.

The above description and drawings illustrative of two embodiments which achieve the objects, features and advantages of the present invention, and is not intended that the present invention be limited thereto. Any modification of the present invention which comes within the spirit and scope of the following claims is considered part of the present invention.

What is claimed as new and desired to be secured by Letters Patent of the United States is:

1. A tube support structure for an equilateral triangular array of generally parallel tubes comprising:

a plurality of mutually parallel first strips each extending in a first direction generally perpendicular to the tubes and between a corresponding pair of rows of tubes of the array;

a plurality of mutually parallel second strips each extending in a second direction generally perpendicular to the tubes and between a corresponding pair of rows of tubes of the array;

a plurality of mutually parallel third strips each extending in a third direction generally perpendicular to the tubes and between a corresponding pair of rows of tubes of the array;

said first direction, said second direction, and said third direction, each being oriented generally sixty degrees from the other two;

each of said plurality of second strips and said plurality of third strips having a plurality of slots formed on one edge thereof;

each of said plurality of first strips having a plurality of slots formed on both edges thereof;

said plurality of first strips being slottingly engaged with and affixed to said plurality of second strips at one edge of said plurality of first strips and being slottingly engaged with and affixed to said plurality of third strips at the other edge of said plurality of first strips thereby forming a multiplicity of hexagonal cells within the tube support each encompassing a single tube and a plurality of dimples in the plurality of strips to contact the tube within the cell.

2. The structure as in claim 1 wherein at least one of said dimples is round.

3. The structure as in claim 1 wherein at least one of said dimples is rectangular.

4. The structure as in claim 1 wherein at least eight dimples are provided for each of the tubes.

5. The structure as in claim 1 wherein said slots are formed in a corresponding strip at an angle corresponding to the direction of the strip engaging said corresponding strip thereof.

6. The structure as in claim 5 wherein an edge of each of said plurality of first strips is generally coplanor with an edge of each of said plurality of second strips and another edge of each of said plurality of first strips is generally coplanor with an edge of each of said plurality of third strips.

7. The structure as in claim 3 wherein said plurality of first strips is affixed to said plurality of second strips and said plurality of third strips at the respective coplanor edges by welding.

* * * * *

UNITED STATES PATENT AND TRADEMARK OFFICE

CERTIFICATE OF CORRECTION

PATENT NO. : 4,359,088

DATED : November 16, 1982

INVENTOR(S) : Felix S. Jabsen

It is certified that error appears in the above-identified patent and that said Letters Patent are hereby corrected as shown below:

Column 3, line 67, delete "logs" and insert — lugs —

Column 6, line 14, delete "coplanor" and insert — coplanar —

Column 6, line 17, delete "coplanor" and insert — coplanar —

Column 6, line 19, delete "3" and insert — 6 —

Column 6, line 21, delete "coplanor" and insert — coplanar —

Signed and Sealed this

*Twenty-fifth* Day of *October 1983*

[SEAL]

*Attest:*

GERALD J. MOSSINGHOFF

*Attesting Officer*

*Commissioner of Patents and Trademarks*